US008621767B2

(12) United States Patent
Vestuti et al.

(10) Patent No.: US 8,621,767 B2
(45) Date of Patent: Jan. 7, 2014

(54) ARTICLE OF FOOTWEAR HAVING A SUPPORT STRUCTURE

(75) Inventors: Ricardo Vestuti, Providence, RI (US); Kevin Leary, Dedham, MA (US); William Marvin, Canton, MA (US); Paul Shinney, Braintree, MA (US); Michael Andrews, East Falmouth, MA (US); William McInnis, Westwood, MA (US); Paul E. Litchfield, Westboro, MA (US)

(73) Assignee: Reebok International Limited, London (GB)

( * ) Notice: Subject to any disclaimer, the term of this patent is extended or adjusted under 35 U.S.C. 154(b) by 570 days.

(21) Appl. No.: 12/463,575

(22) Filed: May 11, 2009

(65) Prior Publication Data

US 2010/0281711 A1 Nov. 11, 2010

(51) Int. Cl.
*A43B 13/18* (2006.01)
*A43B 21/26* (2006.01)

(52) U.S. Cl.
USPC ..... 36/28; 36/35 R

(58) Field of Classification Search
USPC ..... 36/28, 29, 35 B, 35 R, 103
See application file for complete search history.

(56) References Cited

U.S. PATENT DOCUMENTS

| | | | | |
|---|---|---|---|---|
| D271,158 | S | 11/1983 | Hopper | |
| 5,185,943 | A | 2/1993 | Tong et al. | |
| D339,222 | S | 9/1993 | Hatfield et al. | |
| 5,353,526 | A * | 10/1994 | Foley et al. | 36/92 |
| 5,440,826 | A | 8/1995 | Whatley | |
| 5,625,963 | A | 5/1997 | Miller et al. | |
| 5,937,545 | A | 8/1999 | Dyer et al. | |
| 6,108,943 | A | 8/2000 | Hudson et al. | |
| 6,634,121 | B2 | 10/2003 | Sordi | |
| 6,665,958 | B2 | 12/2003 | Goodwin | |
| D485,673 | S | 1/2004 | Smith | |
| D495,129 | S | 8/2004 | Allen | |
| 6,944,973 | B2 | 9/2005 | Goodwin | |
| D511,618 | S | 11/2005 | McDowell et al. | |
| 7,000,335 | B2 * | 2/2006 | Swigart et al. | 36/29 |
| 7,086,179 | B2 * | 8/2006 | Dojan et al. | 36/29 |
| 7,141,131 | B2 * | 11/2006 | Foxen et al. | 156/145 |
| 7,334,349 | B2 * | 2/2008 | Sokolowski et al. | 36/25 R |
| D566,960 | S | 4/2008 | Rivas et al. | |
| 7,637,033 | B2 * | 12/2009 | Sokolowski et al. | 36/25 R |
| 7,707,745 | B2 * | 5/2010 | Schindler et al. | 36/29 |

* cited by examiner

*Primary Examiner* — Jila M Mohandesi
(74) *Attorney, Agent, or Firm* — Sterne, Kessler, Goldstein & Fox P.L.L.C.

(57) ABSTRACT

An article of footwear may include a midsole having a plurality of cavities formed therein and a flexible cage member disposed on the midsole and extending across at least one of the plurality of cavities. The flexible cage member may include a plurality of support arms disposed on the midsole and a linking member extending across at least one of the cavities and connecting at least two of the support arms.

23 Claims, 17 Drawing Sheets

ARTICLE OF FOOTWEAR HAVING A SUPPORT STRUCTURE

FIELD OF THE INVENTION

The present invention relates generally to footwear, and more particularly to articles of footwear having support structures.

BACKGROUND OF THE INVENTION

Articles of footwear typically include an upper and a sole. In athletic shoes, the sole is typically comprised of a foam midsole and a rubber outsole.

When an article of footwear contacts a surface, considerable forces may act on the article of footwear and, correspondingly, the wearer's foot. The sole functions, in part, to cushion to the wearer's foot and to protect it from these forces. To achieve adequate cushioning, many footwear soles are relatively thick and heavy. When sole size and/or weight are reduced to achieve other performance goals, protection of the wearer's foot is often compromised.

Due to ordinary stretch and wear, even the best soles tend to lose their ability to provide adequate cushioning over time. Ideally, the resiliency or "bounce" of the sole should remain relatively constant over the useful life of the article of footwear.

Particularly in the heel region of the article of footwear, additional stability—beyond that provided by the sole itself—is often desired.

Various support structures may be incorporated into articles of footwear to provide required cushioning and/or stability. Using such support structures to strike an optimal balance between cushioning and stability is a difficult task, particularly when an article of footwear that is both relatively inexpensive and easy to manufacture is desired.

Accordingly, a need exists for an article of footwear that is capable of overcoming one or more of the challenges described above.

BRIEF SUMMARY OF THE INVENTION

Embodiments of the present invention may relate to an article of footwear comprising: a midsole having a plurality of cavities formed therein; and a flexible cage member disposed on the midsole and extending across at least one of the cavities.

Embodiments of the present invention may also relate to an article of footwear comprising: a sole having a plurality of exterior sidewalls and a plurality of cavities formed therein, wherein each of the cavities is disposed between adjacent exterior sidewalls; and a flexible support member disposed on the sole. The flexible support member may include a plurality of support arms disposed on the exterior sidewalls; and a linking member connecting two or more of the support arms and extending across at least one of the cavities.

Embodiments of the present invention may further relate to an article of footwear having a sole having a heel portion and a plurality of exterior sidewalls and a plurality of cavities formed therein, wherein each of the cavities is disposed between adjacent exterior sidewalls. A lateral flexible support member may be disposed on a lateral side of the heel portion; and a medial flexible support member may be disposed on a medial side of the heel portion. The lateral and medial flexible support members may include a plurality of support arms disposed on the exterior sidewalls; and a linking member connecting two or more of the support arms and extending across at least one of the cavities.

Further embodiments, features, and advantages of the present invention, as well as the structure and operation of the various embodiments of the present invention, are described in detail below with reference to the accompanying figures.

BRIEF DESCRIPTION OF THE FIGURES

The accompanying figures, which are incorporated herein and form a part of the specification, illustrate several embodiments of the present invention by way of example, and not by way of limitation, and, together with the description, further serve to explain the principles of the invention and to enable a person skilled in the pertinent art to make and use the invention.

DETAILED DESCRIPTION OF THE INVENTION

The present invention will now be described in detail with reference to embodiments thereof as illustrated in the accompanying figures. While specific configurations and arrangements are discussed, it should be understood that this is done for illustrative purposes only. References to "an embodiment", "one embodiment", "another embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, a person skilled in the relevant art will recognize that other configurations and arrangements can be used without departing from the spirit and scope of the invention.

Figure 1:
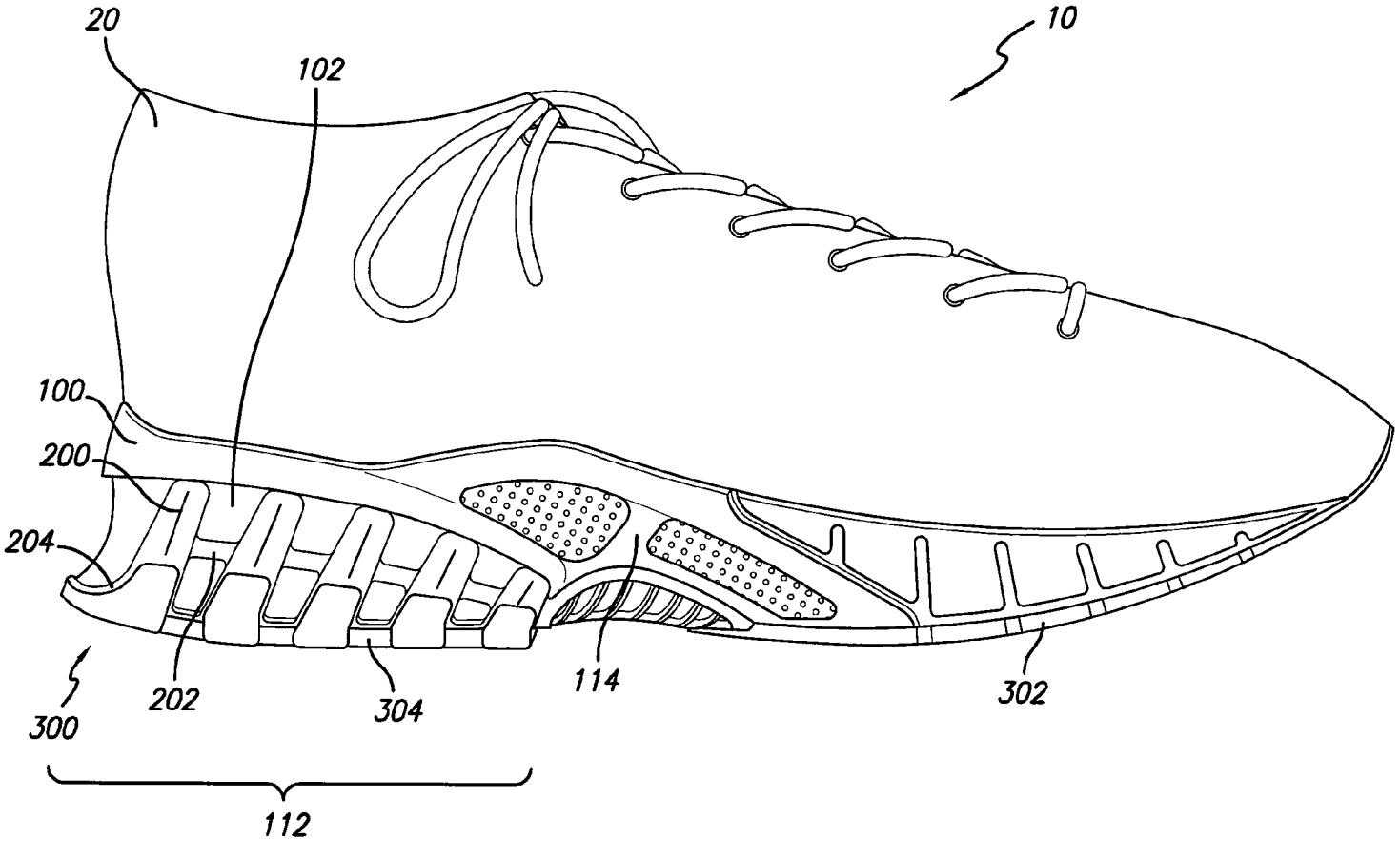
FIG. 1 is a medial side view of an article of footwear according to an embodiment of the present invention.

An article of footwear 10 according to one embodiment of the present invention is shown generally in FIG. 1. Although the article of footwear 10 may be referred to herein as a shoe 10, it is contemplated that it may comprise any type of footwear including, but not limited to, running shoes, basketball shoes, court shoes, tennis shoes, training shoes, cleated footwear, sandals, casual shoes, or boots.

To the extent that only the left or right article of footwear 10 is described for a particular embodiment of the present invention, it will be apparent to one of ordinary skill in the art that the article of footwear 10 suitable for the other foot, even if not specifically described, may comprise a mirror image of the described article of footwear 10.

Articles of footwear 10 according to embodiments of the present invention may include an upper 20 disposed above a sole 100. The upper 20 may be formed to generally accommodate a human foot, and may comprise one or more textiles made of natural or man-made fibers. Materials appropriate for the upper 20 including, but not limited to, leather, rubber, and plastic, are considered to be within the scope of the present invention.

In one embodiment of the present invention, as shown in FIG. 1, an article of footwear 10 may include a sole 100 with one or more cavities 102 formed in the sole 100. A plurality of support arms 200 may be disposed on, or over, the sole 100. One or more linking members 202 may extend across the one or more cavities 102 and may connect two or more of the plurality of the support arms 200. In this manner, support arms 200 and linking members 202 may form a flexible cage structure. In some embodiments, the flexible cage structure is disposed on or over a midsole member of sole 100 and is entirely external to the midsole member. In other embodiments, the flexible cage structure is contained within the midsole member or portions of the flexible cage structure can extend into the midsole member.

The flexible cage structure can be attached to an existing sole member or the flexible cage structure can be attached to a sole member during formation of the sole member. Such a sole member can include a full or partial sole (e.g., a medial and/or lateral heel portion sole member or a medial and/or lateral forefoot sole member). In one embodiment, the flexible cage structure is attached to an existing sole member using an adhesive. In another embodiment, a sole member is molded around the flexible cage structure, for example, by placing the flexible cage structure in a mold and then molding the sole member around the flexible cage structure. In some embodiments, at least one of the support arms is attached to the sole member. For example, at least the upper portion of at least one support arm is attached to the sole member. In some embodiments, the upper portions of all of the support arms are attached to the sole member.

The sole 100 may be a midsole of an athletic shoe 10 and may provide cushioning and/or stability to the shoe 10. The sole 100 may comprise a foam such as, for example, ethyl vinyl acetate (EVA). Other materials appropriate for the sole 100 include, but are not limited to, polyurethane (PU), thermoplastic urethane (TPU), and thermoplastic rubber (TPR). The sole 100 may be constructed of one or more materials, and may have zones of differing densities.

Figure 2:
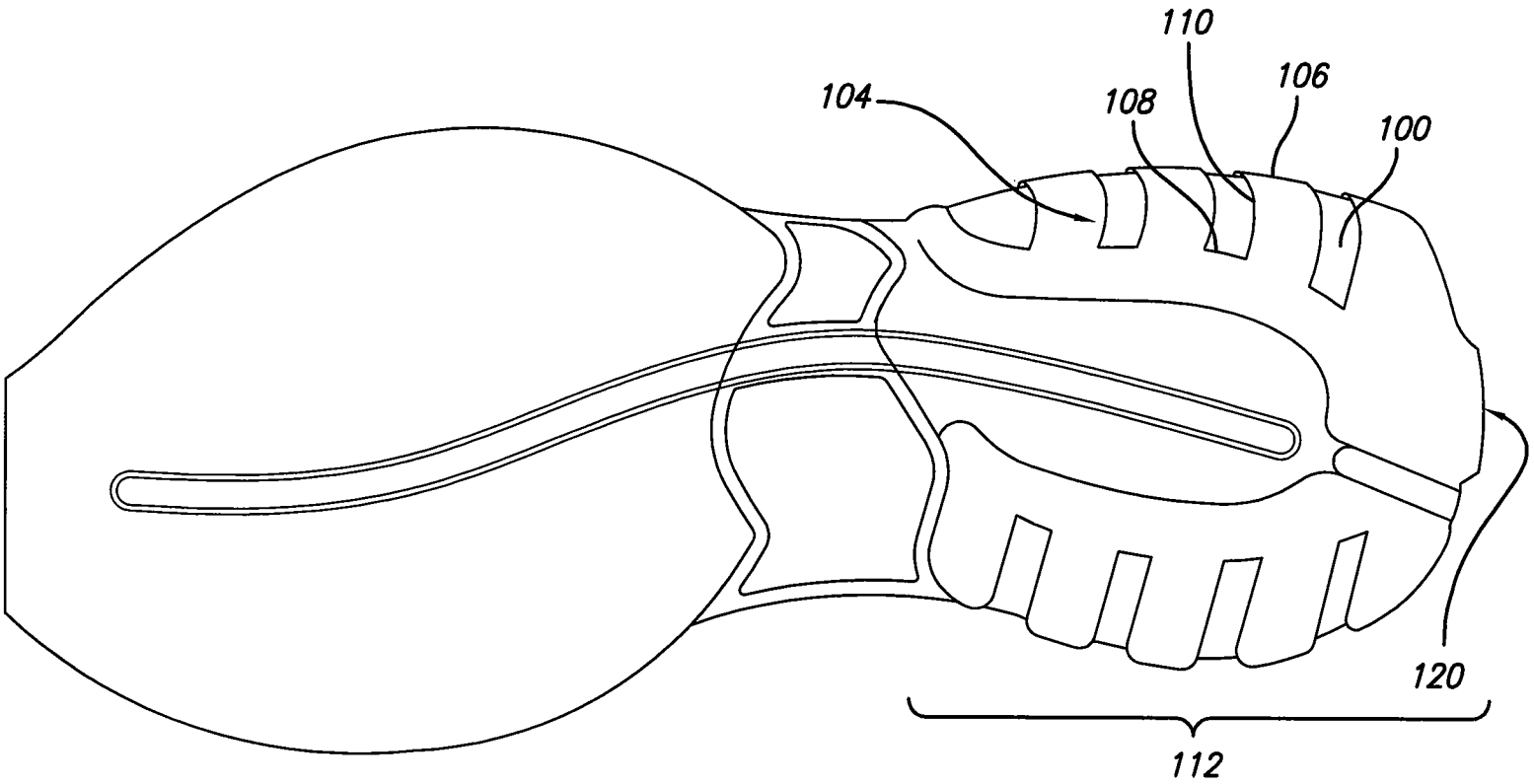
FIG. 2 is a bottom view of the midsole of an article of footwear with its support arms and ground engaging members removed according to an embodiment of the present invention.

The sole 100 may include one or more cavities 102. The cavities 102 of one embodiment of the present invention are best shown in FIG. 2, which is a bottom view of the midsole 100 of an athletic shoe 10, wherein the support arms 200 and linking members 202 have been removed to better illustrate the cavities. In some embodiments, including cavities 102 in the sole 100 may reduce the overall weight of the article of footwear 10. For athletic shoes 10 in particular, this may be advantageous in that the wearer may be able to run or make other athletic movements more quickly than when wearing a heavier shoe 10. Without wishing to be bound by any particular theory, it is also believed that athletic shoes which include cavities in the sole, for example, as illustrated in FIG. 2, can better accommodate shear or other forces than conventional athletic shoes by providing a sole structure that can flex and deform in response to shear or other forces. In some embodiments, cavities 102 are empty cavities. In other embodiments, cavities 102 can be filled with one or more materials that are different from one or more materials used in the remainder of the sole (e.g., the midsole). For example, in one embodiment, cavities 102 are filled with a material, such as a foam, that has a different hardness or compressibility than the material used in the majority of the remainder of the sole (e.g., the midsole).

The cavities 102 may be formed by discontinuities 104 in the sole 100 material. With reference to FIG. 2, in one embodiment of the present invention, the sole 100 may include a plurality of exterior side wall surfaces 106, one or more interior side wall surfaces 108, and a plurality of joining surfaces 110 connecting the exterior and interior side wall surfaces 106 and 108. The cavities 102 may be defined by the space between the exterior side wall, interior side wall, and joining surfaces 106, 108, and 110. The cavities can be formed in the sole simultaneously with formation of the sole, e.g., by molding. Alternatively, the cavities can be formed in an existing sole by methods such as, for example, cutting, boring, or melting.

The size and shape of the cavities 102 may vary according to embodiments of the present invention. The cavities can include, but are not limited to, generally box-shaped cavities, generally cylindrical cavities, channel-like cavities, and combinations thereof. In some embodiments, the cavities can include generally vertical channels. For example, the cavities can include generally vertical channels that extend through the bottom surface of the sole. In one embodiment, as shown in FIGS. 1 and 2, the cavities 102 may comprise generally vertical channels with a slight forward tilt. The cavities may extend through the bottom surface 118 of the sole 100. In other embodiments, the cavities do not extend through the bottom surface 118 of the sole 100. For example, in some embodiments, the cavities include holes extending into the sole 100 from the side of the sole 100. Other cavity configurations are considered to be within the scope of the present invention provided a void is formed in at least a portion of sole 100 that may otherwise have contained the material of sole 100.

Further, while the embodiment of FIG. 2 includes defined, flat side wall surfaces meeting each other at angles, other embodiments can include rounded or otherwise gradual transitions between exterior side wall, interior side wall, and joining surfaces 106, 108, and 110.

In some embodiments, one or more cavities are at least about 3 mm in width or diameter. For example, one or more cavities can be at least about 5 mm, at least about 7 mm, at least about 10 mm, or at least about 13 mm in width or diameter. In some embodiments, all of the cavities are the same width or diameter. However, in other embodiments, one or more of the cavities has a different width or diameter from the others. In some instances, the width or diameter of the cavities progressively changes as a function of the location of the cavities in a forefoot to heel direction. For example, the width or diameter of the cavities can progressively increase as a function of the location of the cavities in a forefoot to heel direction, e.g., the width or diameter of the heel-most cavity is largest and the width or diameter of the forefoot-most cavity is smallest. In some embodiments, the width or diameter of a cavity can vary along its length.

A plurality of support arms 200 may be disposed on the sole 100. Generally, the support arms 200 may be adapted to provide additional cushioning and/or stability to portions of the sole 100. The support arms 200 may comprise, for example, thermoplastic materials such as thermoplastic urethane (TPU), thermoplastic elastomer (TPE), thermoplastic rubber (TPR), thermoplastic vulcanizate (TPV), latex, and combinations thereof. In one embodiment, the support arms include a polyester-based TPU such as, for example, Elastollan® 685A10 (Elastollan is a trademark of BASF Corporation; Florham Park, N.J.) or a polyether block amide such as, for example, PEBAX® 6333 or 7233 (Arkema, Inc.; Philadelphia, Pa.). Other materials appropriate for the support arms 200 including, but not limited to, various plastics, rubbers, reinforced materials (such as, for example, glass-fiber reinforced materials), and suitable composite materials are considered to be within the scope of the present invention. All of the support arms 200 can be formed of the same material or, alternatively, one or more of the support arms can be formed of different materials. Thus, in some embodiments, the support arms 200 can be formed of different materials and thereby the cushioning or control characteristics of portions of the flexible cage structure can be varied. The support arms 200 may be formed, for example, by injection molding, blow molding, compression molding, die cutting, or stamping.

The material or materials used for the support arms 200 may be selected to achieve a desired level of support, cushioning, and/or stability in a particular region of sole 100 of the article of footwear 10. Generally, more flexible materials may provide better cushioning, while stiffer materials may provide increased stability. In some embodiments, the support arms have a Shore A hardness of about 65 to about 95 such as about 65 to about 90; about 65 to about 85; or about 85. In other embodiments, the support arms have a Shore D hardness of about 30 to about 70 such as about 50 to about 70; about 60 to about 65; or about 65.

Generally, the support arms can be of any dimension. In some embodiments, the support arms have a thickness of at least about 0.5 mm such as, for example, about 0.5 to about 4 mm; about 0.75 to about 3 mm; about 1 to about 2.5 mm; or about 1 to about 2 mm.

Figure 3:
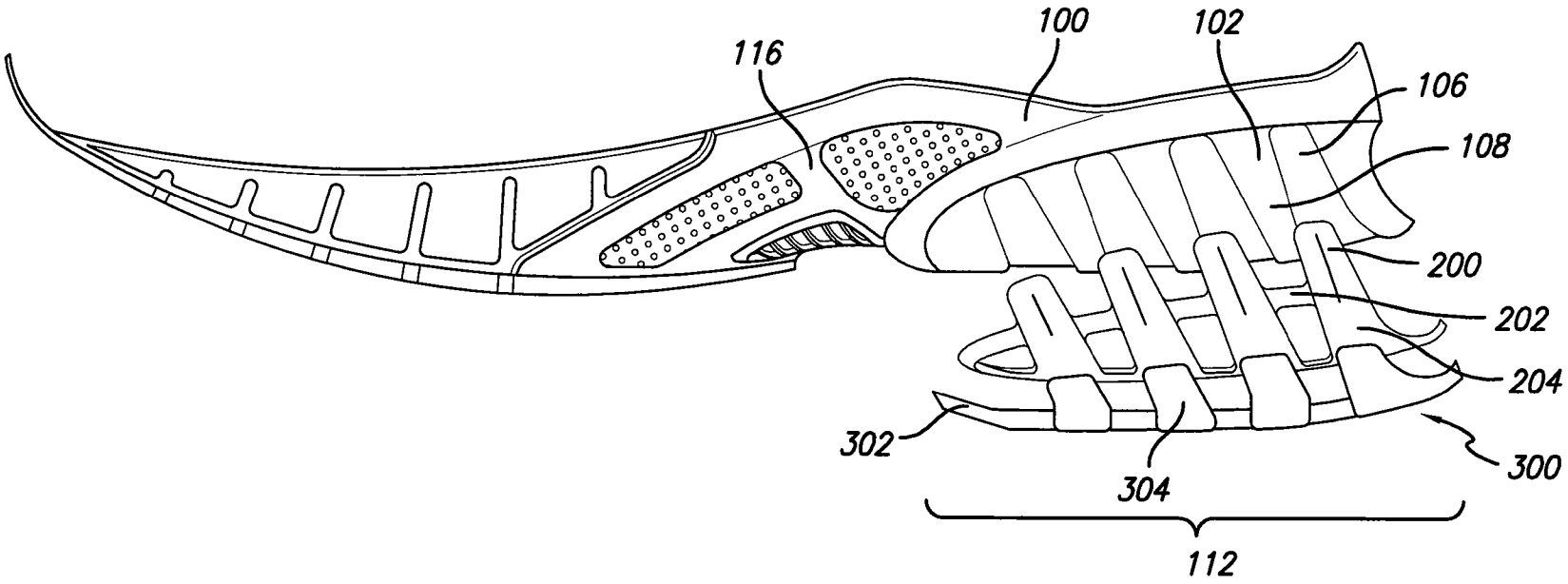
FIG. 3 is an exploded side view of the sole of an article of footwear according to an embodiment of the present invention.
Figure 4:
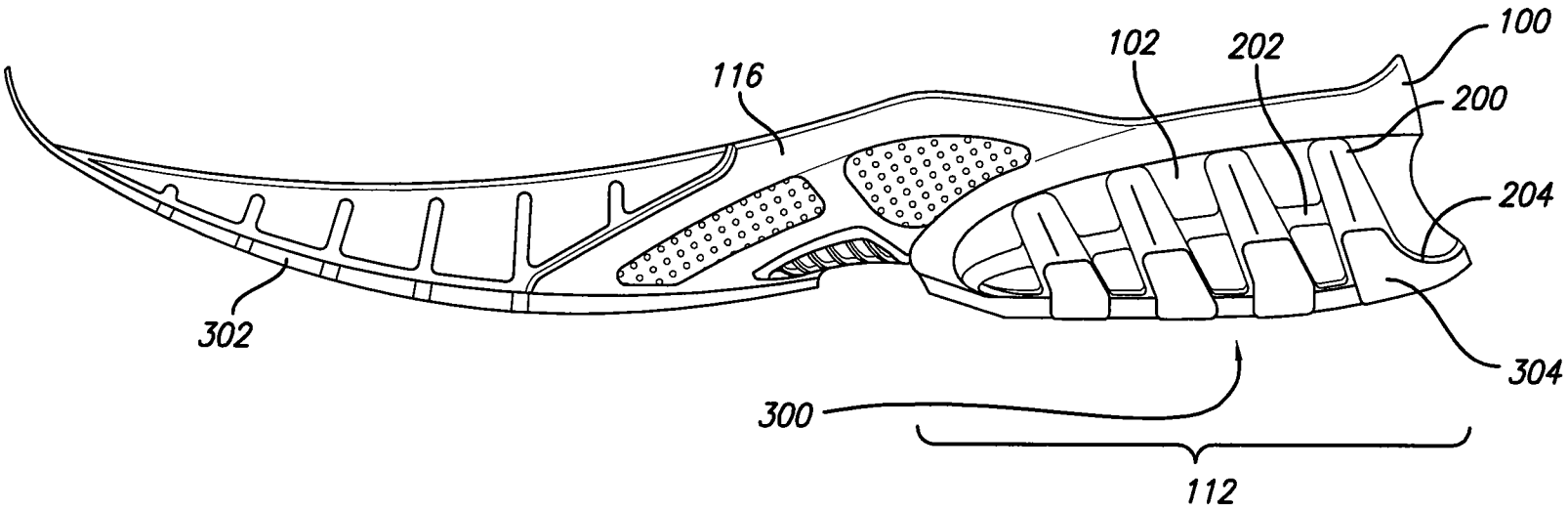
FIG. 4 is a lateral side view of the sole of an article of footwear according to an embodiment of the present invention.

As illustrated in FIG. 3, the support arms 200 may be disposed on or over the exterior side wall surfaces 106 of the sole 100. A fully assembled version of the embodiment of FIG. 3 is shown in FIG. 4. The support arms 200 may approximate the shapes of the exterior side wall surfaces 106 that the support arms 200 are disposed on, as shown in FIGS. 3 and 4. For example, support arms 200 can bend outwardly from the sole 100 and exterior side wall surfaces 106 may similarly extend outwardly so as to accommodate the support arms 200. In other embodiments of the present invention, the support arms 200 may have shapes that differ from that of the corresponding exterior side wall surfaces 106. In some instances, the support arms 200 bend outwardly from the sole 100 and a gap exists between the support arms 200 and the exterior side wall surfaces 106.

In embodiments of the present invention where the support arms 200 are disposed on the exterior side wall surfaces 106 of the sole 100, spaces may be present between adjacent support arm 200 edges due to the presence of the one or more cavities 102 existing between the exterior side wall surfaces 106. In this configuration, the support arms 200 may be capable of providing additional cushioning and stability in a region of the sole 100 where cushioning and stability have been reduced due to the presence of the cavities 102 in the sole 100. The support arms 200 may also help to maintain the resiliency or "bounce" of the sole 100 for a longer period of time because a portions of the forces acting on the footwear 10 will be imparted to the support arms 200 instead of the sole 100 itself.

With reference to FIGS. 3 and 4, one or more linking members 202 may extend across the cavities 102, and may connect a plurality of support arms 200. In general, the linking members 202 include one or more of the materials, described supra, for use in support arms 200. However, one or more linking members 202 may or may not comprise the same materials as one or more of support arms 200. In some embodiments, the linking members 202 include one or more materials with different properties from those of the materials of the support arms 200.

All of the linking members can be formed of the same material or, alternatively, one or more of the linking members can be formed of different materials than the other linking members. Thus, in some embodiments, one or more of linking members can be formed of different materials and thereby the cushioning or control characteristics of portions of the flexible cage structure can be varied.

The linking members 202 may or may not be integrally formed with the support arms 200, such as by injection molding, blow molding, compression molding, die cutting, or stamping. While the embodiment illustrated by FIGS. 3 and 4 shows two sets of roughly horizontal linking members 202, alternate embodiments containing any number of linking members in other orientations are considered to be within the scope of the present invention. The embodiment illustrated in FIG. 4 includes linking member 202 which extends across and partially covers cavity 102. In other embodiments, a linking member 202 can extend across and substantially, or fully, cover a cavity 102. In some embodiments, a linking member 202 can include one or more transparent or translucent portions or windows that extend across and cover all or part of a cavity 102. In other instances, a linking member 202 can include a frame portion of a window member that extends across and covers all or part of a cavity 102.

Generally, the linking members 202 can be of any dimension. In some embodiments, the linking members 202 have a thickness of at least about 0.5 mm such as, for example, about 0.5 to about 4 mm; about 0.75 to about 3 mm; about 1 to about 2.5 mm; or about 1 to about 2 mm. In some instances, the maximum thickness of at least one linking member 202 is less than the maximum thickness of at least one support arm 200. In some embodiments, wherein the linking member 202 includes a window member, the window member can be made of different material(s) than the support arms 200 and/or have a different thickness.

The linking members 202 may assist in providing cushioning and/or stability to the portions of the sole 100 where the cavities 102 are disposed. This may be accomplished by offering additional resiliency to the support arms 200 that are flexed during a wearer's stride, and by further stabilizing the support arms 200 and their underlying sole 100 portions in the vicinity of the cavities 102. In some embodiments, the linking members 202 can help to moderate the dynamics of the portions of the sole 100 adjacent to the cavities 102 and/or of the support arms 200.

Without wishing to be bound by any particular theory, it is believed that athletic shoes which include cavities 102 in the midsole, for example, as illustrated in FIG. 2, can better accommodate shear forces than conventional athletic shoes by providing a midsole structure that can flex and deform in response to shear forces. However, when the midsole contains cavities 102, the structural integrity or the resiliency of the midsole can be compromised. The flexible cage members described herein can help to maintain or improve the structural integrity or the resiliency of the sole as a whole. Further, the flexible cage members described herein can help to moderate the dynamics of the sole.

Figure 5:
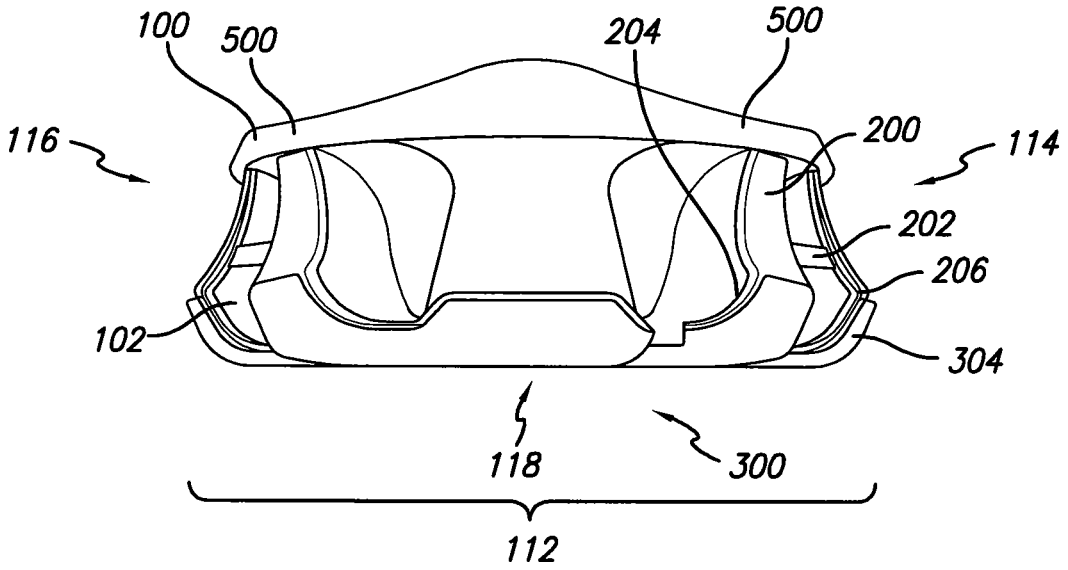
FIG. 5 is a rear view of the sole of an article of footwear according to an embodiment of the present invention.

As best shown in FIG. 5, in one embodiment of the present invention, lower portions 204 of the support arms 200 may extend underneath a portion of a bottom surface 118 of the sole 100. For example, in the case of an athletic shoe 10, the lower portions 204 may extend underneath a portion of the bottom surface 118 of the midsole 100. Support arms 200 with lower portions 204 that extend underneath the sole 100 may be fixed to the bottom surface 118 by adhesives, frictional force between the sole 100 and another contacting member, and/or other means known in the art. When the lower portions 204 of the support arms 200 are anchored in this way, the support arms 200 may be capable of acting as cantilevers to resist motion of higher portions of the support arms 200 during a wearer's stride, thus enhancing the cushioning and/or stability characteristics of the sole 100.

As also shown in FIG. 5, in some embodiments, upper tips of support arms 200 can extend to or abut a sole ridge 500. In one preferred embodiment, the upper portions of support arms 200 abut sole ridge 500.

The support arms 200 may include angled or curved portions 206, examples of which are shown in FIG. 5. Such angled or curved portions 206 may similarly aid in enhancing cushioning and/or stability characteristics of the sole 100 during a wearer's stride, and additionally may allow the support arms 200 to better contour the shape of the side walls of the sole 100. As discussed above, the exterior side walls of the sole 100 may be similarly angled or curved to receive the support arms 200 and enhance cushioning and/or stability characteristics of the sole 100. In some embodiments, the flexible support cage can act as a spring. For example, support arm 200 and/or angled or curved portions 206 can act to absorb and return energy during use of the footwear. Thus, support arm 200 and/or angled or curved portions 206 can cushion and stabilize the shoe during use.

Figure 6:
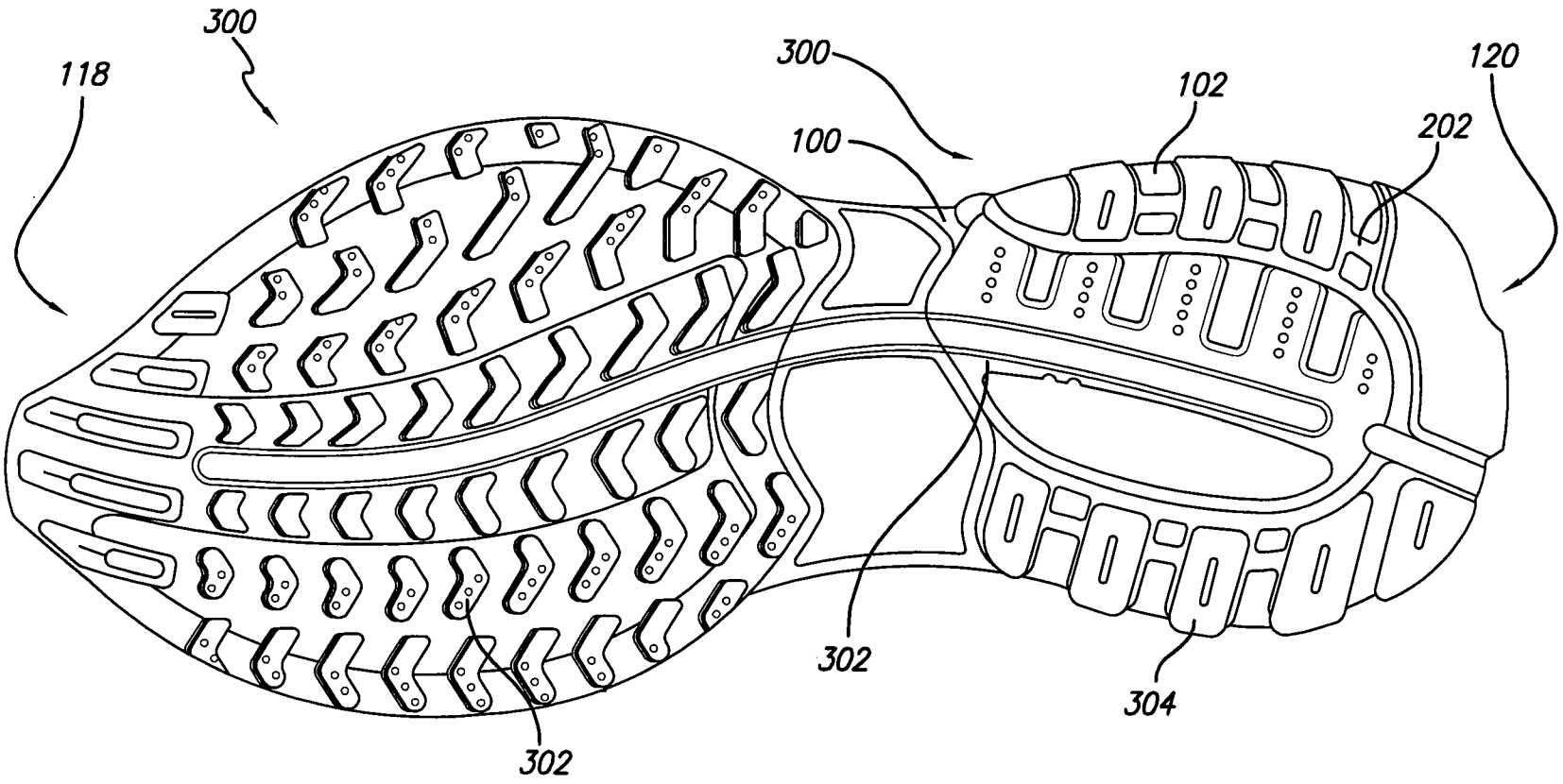
FIG. 6 is a bottom view of the sole of an article of footwear according to an embodiment of the present invention.
Figure 7:
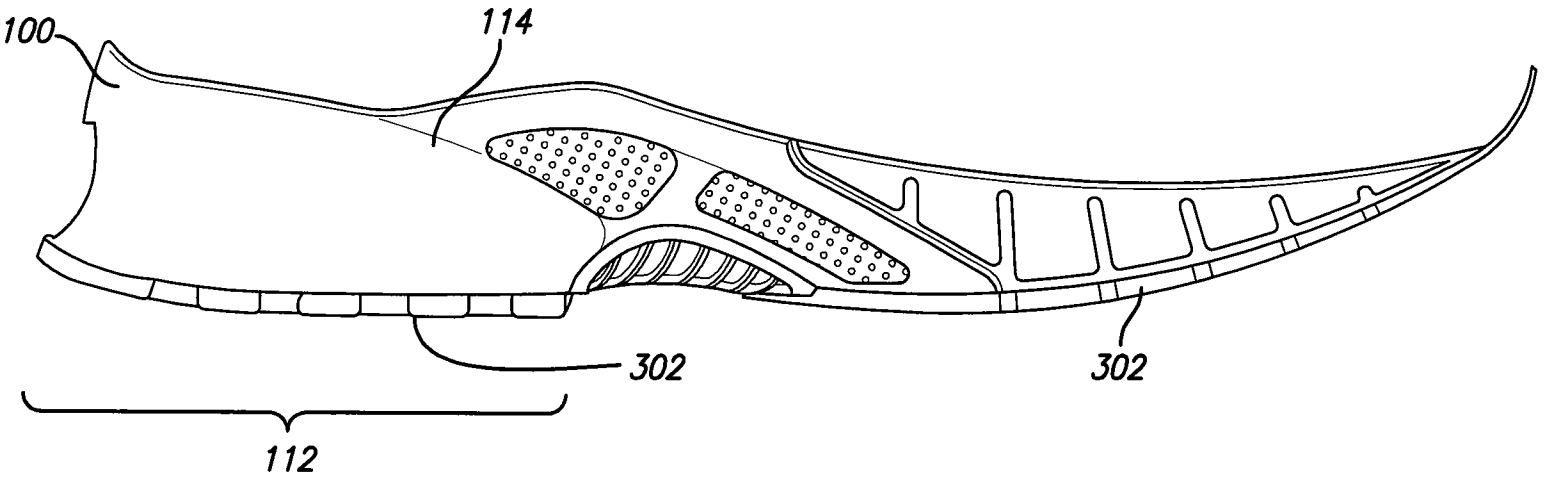
FIG. 7 is a medial side view of the sole of an article of footwear according to an embodiment of the present invention.
Figure 8:
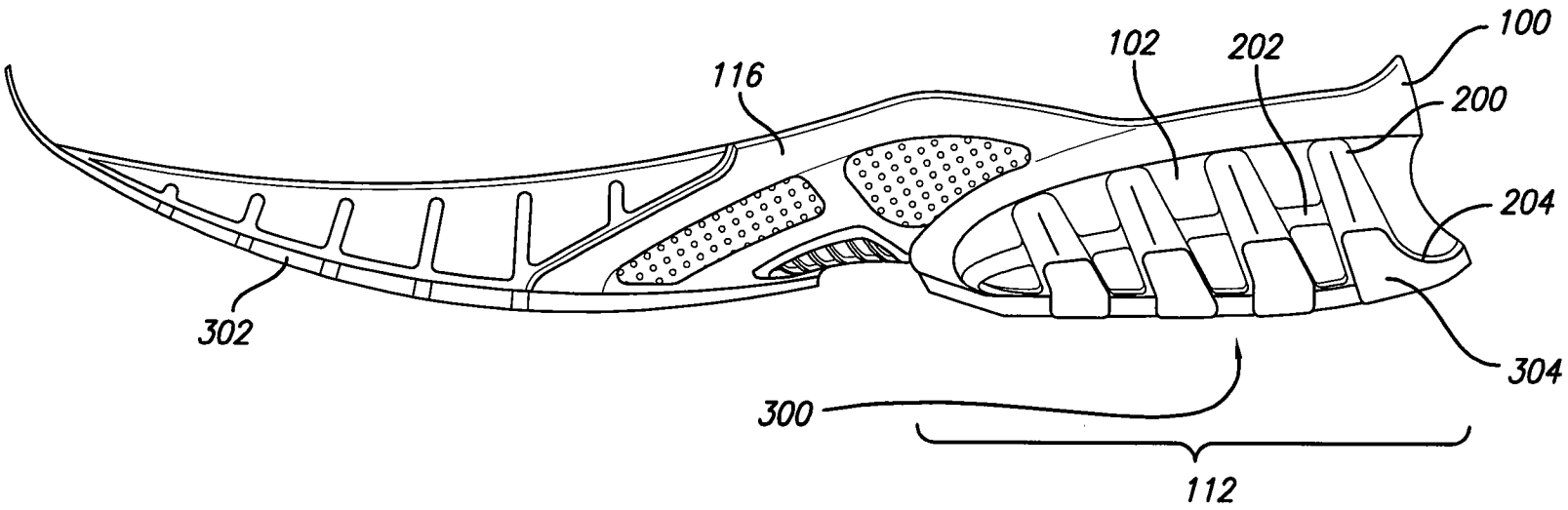
FIG. 8 is a lateral side view of the sole of an article of footwear according to an embodiment of the present invention.
Figure 9:
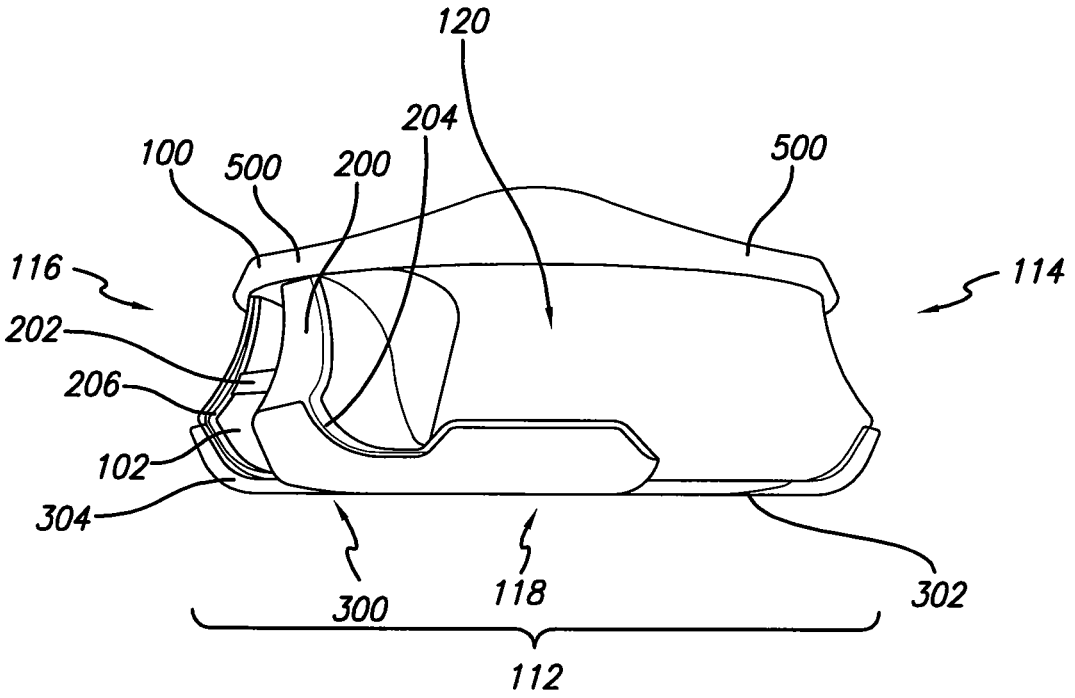
FIG. 9 is a rear view of the sole of an article of footwear according to an embodiment of the present invention.
Figure 10:
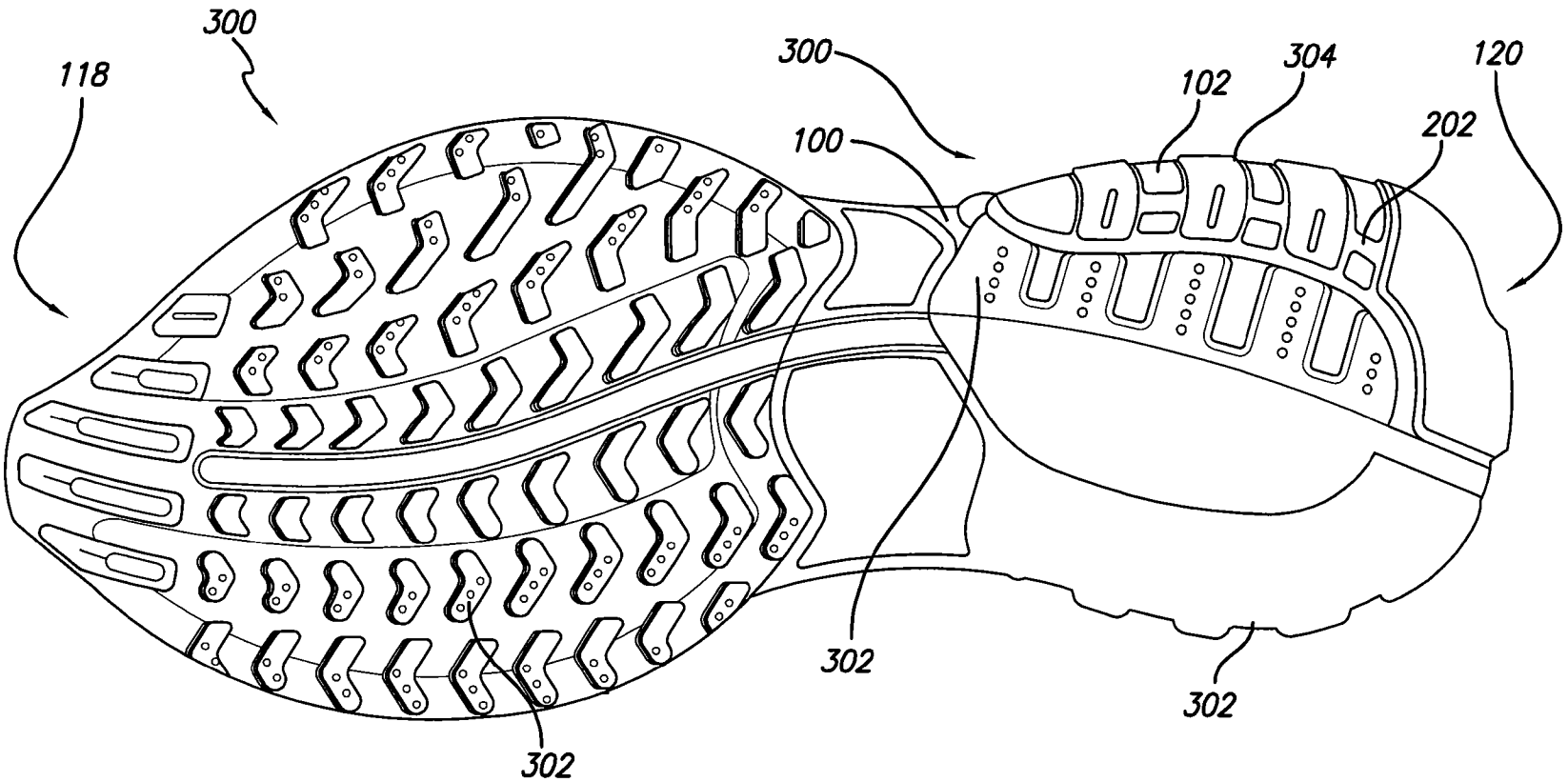
FIG. 10 is a bottom view of the sole of an article of footwear according to an embodiment of the present invention.

Ground engaging members 300 may also be disposed on articles of footwear according to the present invention. The ground engaging members 300 may comprise TPU, and may be formed by injection molding. Other materials appropriate for the ground engaging members 300 including, but not limited to, various plastics or rubbers are considered to be within the scope of the present invention. With reference to FIG. 6, first ground engaging members 302 may be disposed on the bottom surface 118 of the sole 100. In an athletic shoe 10, the first ground engaging members 302 may comprise one or more outsole portions known in the art. The first ground engaging members 302 may primarily function to provide traction and reduce wear on the article of footwear 10.

As illustrated in FIG. 3, an exploded side view of the sole of an article of footwear according to an embodiment of the present invention, second ground engaging members 304 may be disposed on the support arms 200. A fully assembled version of the embodiment of FIG. 3 is shown in FIG. 4. The second ground engaging members 304 may approximate the shapes of the support arms 200 that the second ground engaging members 304 are disposed on, as shown in FIGS. 3 and 4. In other embodiments of the present invention, the second ground engaging members 304 may have shapes that differ from that of the corresponding support arms 200. The second ground engaging members 304 may be injection molded with the support arms 200 so as to fixedly attach them to one another.

In some embodiments of the present invention, as shown in FIG. 5, the second ground engaging members 304 may be disposed on the lower portions 204 of the components 200. The second ground engaging members 304 may be connected to the first ground engaging members 302, or the second ground engaging members 304 may be separate elements. The second ground engaging members 304 may function similarly to the first ground engaging members 302 in that they may provide traction and reduce wear on the article of footwear 10. However, because they may be disposed on the support arms 200, the second ground engaging members 304 may specifically reduce wear on the support arms 200.

In embodiments where spaces are present between adjacent support arm 200 edges because of the one or more cavities 102 existing between the exterior side wall surfaces 106, corresponding spaces may also be present between second ground engaging member 304 edges. In this manner, second ground engaging members 304 may be capable of providing traction and wear resistance to the footwear 10 overall, as well as protection of the underlying support arms 200, without unnecessarily restricting the movement of the individual support arms 200 or adding unwanted weight to the footwear 10.

The cavities 102, support arms 200, and/or second ground engaging elements 300, may be located in the heel 112, midfoot, or forefoot regions of the sole 100. Further, the cavities 102, support arms 200, and/or second ground engaging elements 300 may be disposed on the medial 114, lateral 116, and/or rear 120 side walls of the sole 100. FIGS. 1, 4, 5, and 6 illustrate an embodiment of the present invention wherein these three elements are disposed on both the medial and lateral sides 114 and 116 of the sole 100. FIGS. 7, 8, 9, and 10 illustrate an embodiment of the present invention wherein these three elements are disposed on lateral side 116, but not the medial side 114, of the sole 100. In both the embodiments shown in FIG. 5 and in FIG. 9, the cavities 102, support arms 200, and/or second ground engaging elements 300 also extend partially around the rear side 120 wall of the sole 100. In another embodiment, the cavities 102, support arms 200, and/or second ground engaging elements 300 can extend fully around the rear side 120 wall of the sole 100.

As will be appreciated by those of ordinary skill in the art, depending on the intended use of the article of footwear 10 or on individual characteristics or preferences of the wearer of the footwear 10, it may be desirable to locate the cavities 102, support arms 200, and/or second ground engaging elements 300 at different locations to provide different levels of cushioning and/or support in different areas of the footwear 10.

Figure 11A:
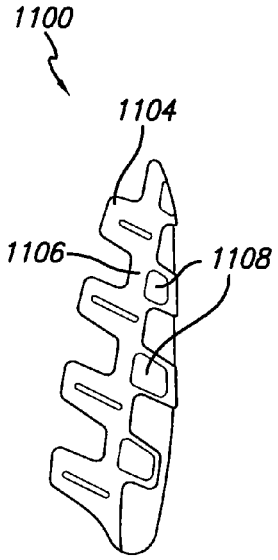
FIGS. 11A, 11B, and 11C are medial side, bottom, and lateral side views of flexible cage structures according to some embodiments of the present invention.
Figure 11B:
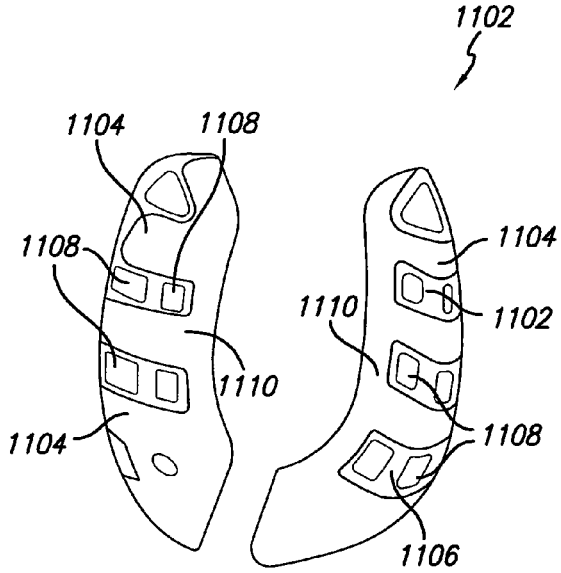
Figure 11C:
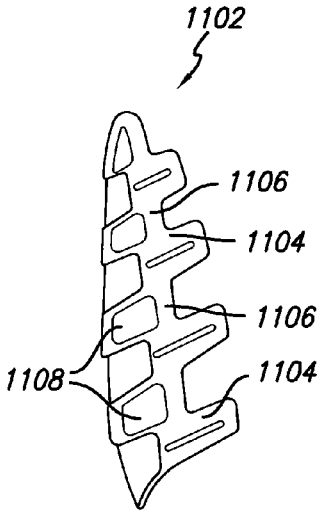
Figure 12A:
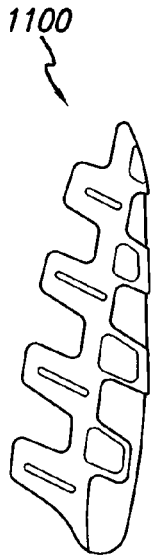
FIGS. 12A, 12B, and 12C are medial side, bottom, and lateral side views of flexible cage structures according to some embodiments of the present invention.
Figure 12B:
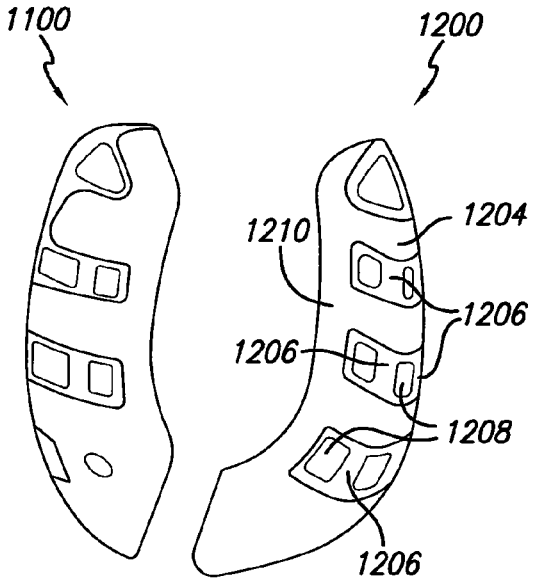
Figure 12C:
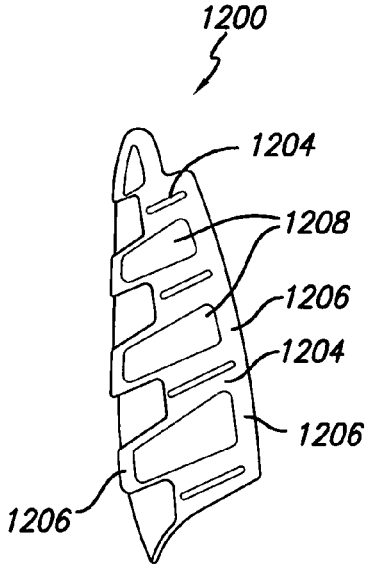
Figure 13A:
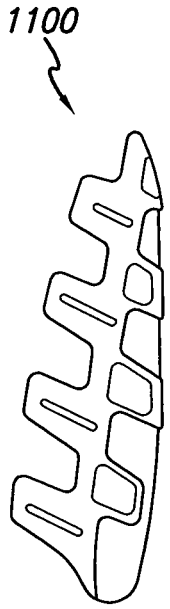
FIGS. 13A, 13B, and 13C are medial side, bottom, and lateral side views of flexible cage structures according to some embodiments of the present invention.
Figure 13B:
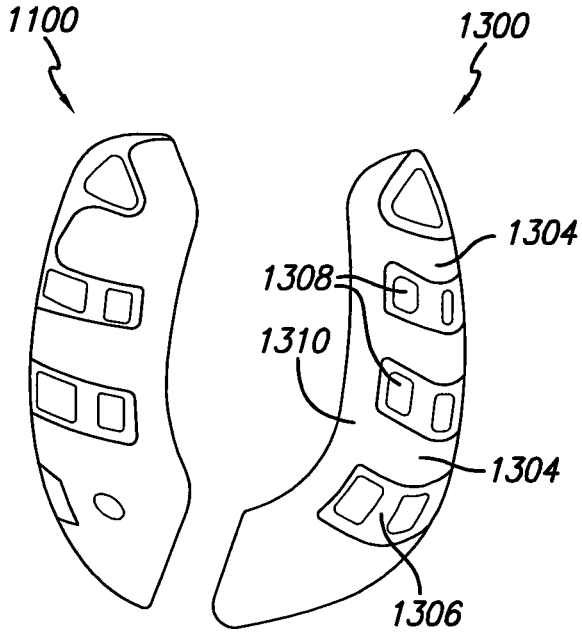
Figure 13C:
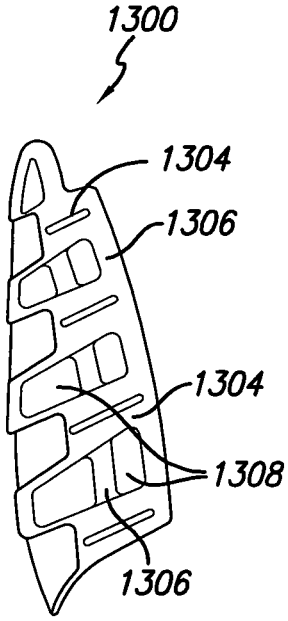

FIGS. 11A, 11B, and 11C are medial side, bottom, and lateral side views of flexible cage structures according to some embodiments of the present invention. Flexible cage structures 1100 and 1102 include support arms 1104, linking members 1106, apertures 1108, and spine member 1110. Apertures 1108 are defined by support arms 1104 and linking members 1106. In some embodiments, apertures 1108 can be covered or replaced with material, for example, to form a window. Apertures can be covered or replaced with a material such as those appropriate for the support arms or linking members and described herein. The material used can be opaque, translucent, or transparent. Spine member 1110 can connect support arms 1104. When applied to a sole member, spine member 1110 can extend across one or more cavities in the sole or can be positioned so that spine member 1110 lies at least partially, preferably fully, on the sole material.

FIGS. 12A, 12B, 12C, 13A, 13B, and 13C are medial side, bottom, and lateral side views of flexible cage structures according to some embodiments of the present invention. Flexible cage structures 1200, 1300 include support arms 1204, 1304; linking members 1206, 1306; apertures 1208, 1308; and spine members 1210, 1310. Apertures 1208, 1308 are defined by support arms 1204, 1304 and linking members 1206, 1306. In some embodiments, apertures 1208, 1308 can be covered or replaced with material as described supra. While flexible cage structures 1200, 1300 are shown as lateral cage structures, medial cage structures with similar construction are also contemplated.

Figure 14:
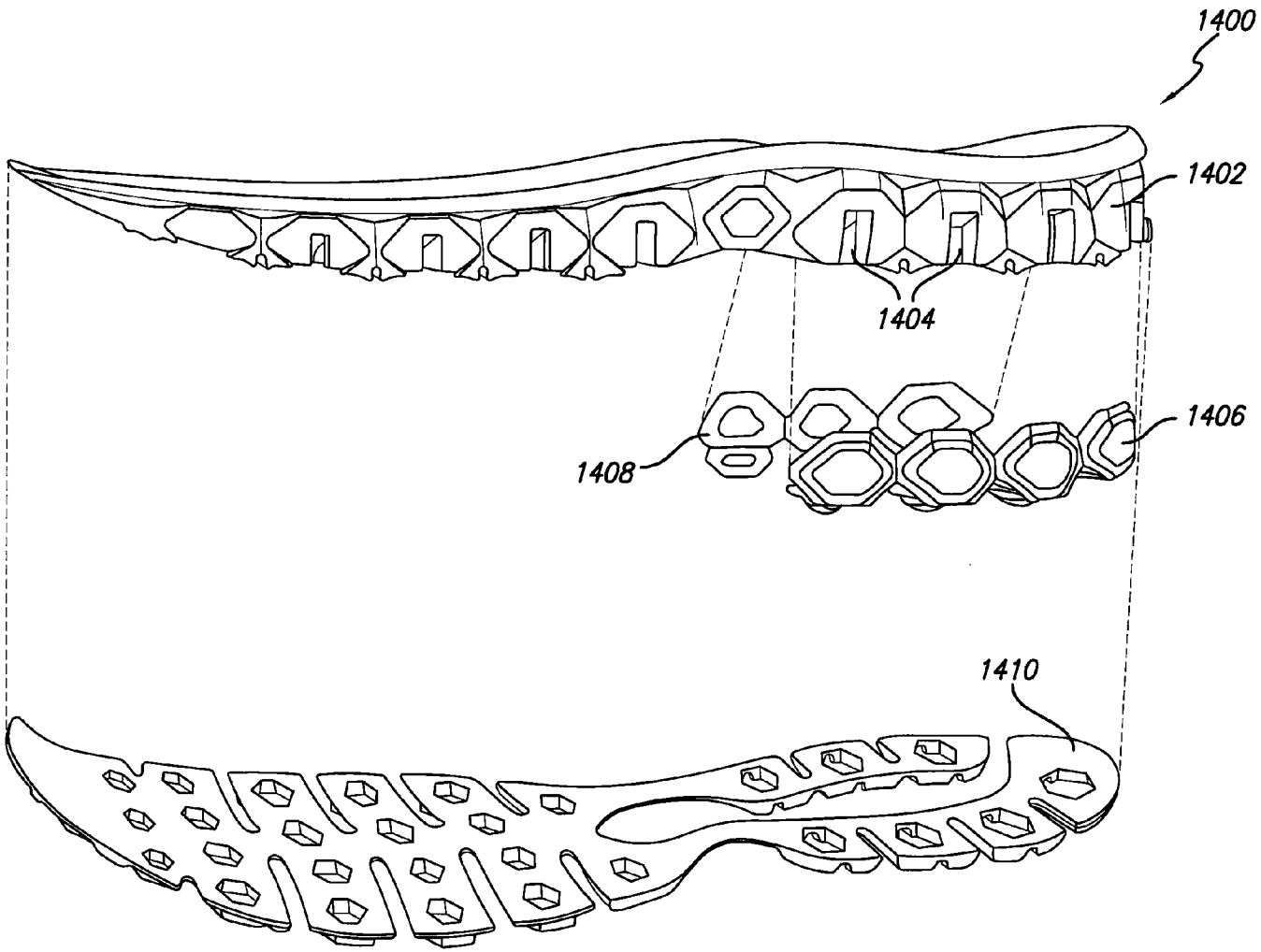
FIG. 14 is an exploded lateral side view of the sole of an article of footwear according to one embodiment of the present invention.
Figure 15:
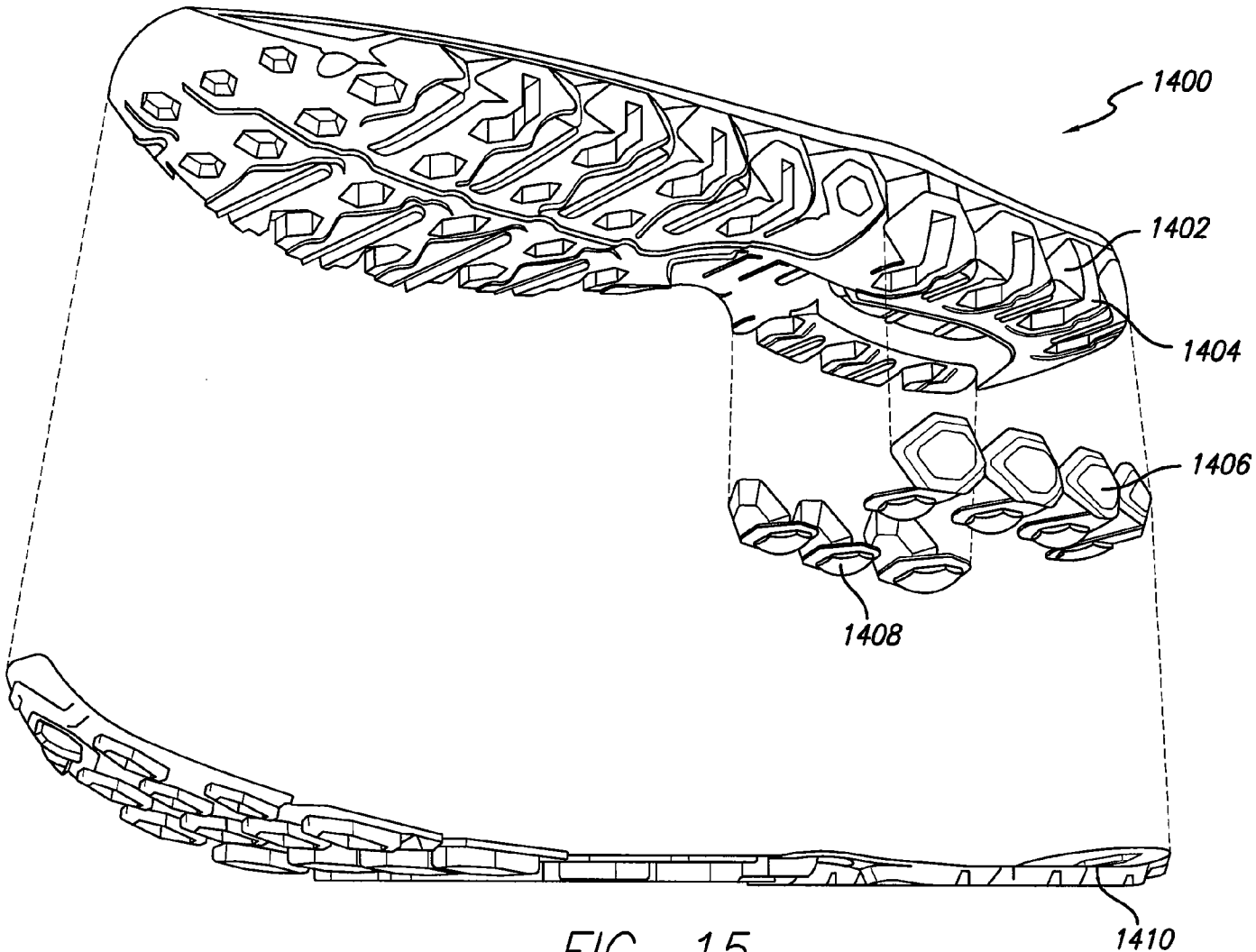
FIG. 15 is an exploded bottom view of the sole of FIG. 14.
Figure 16:
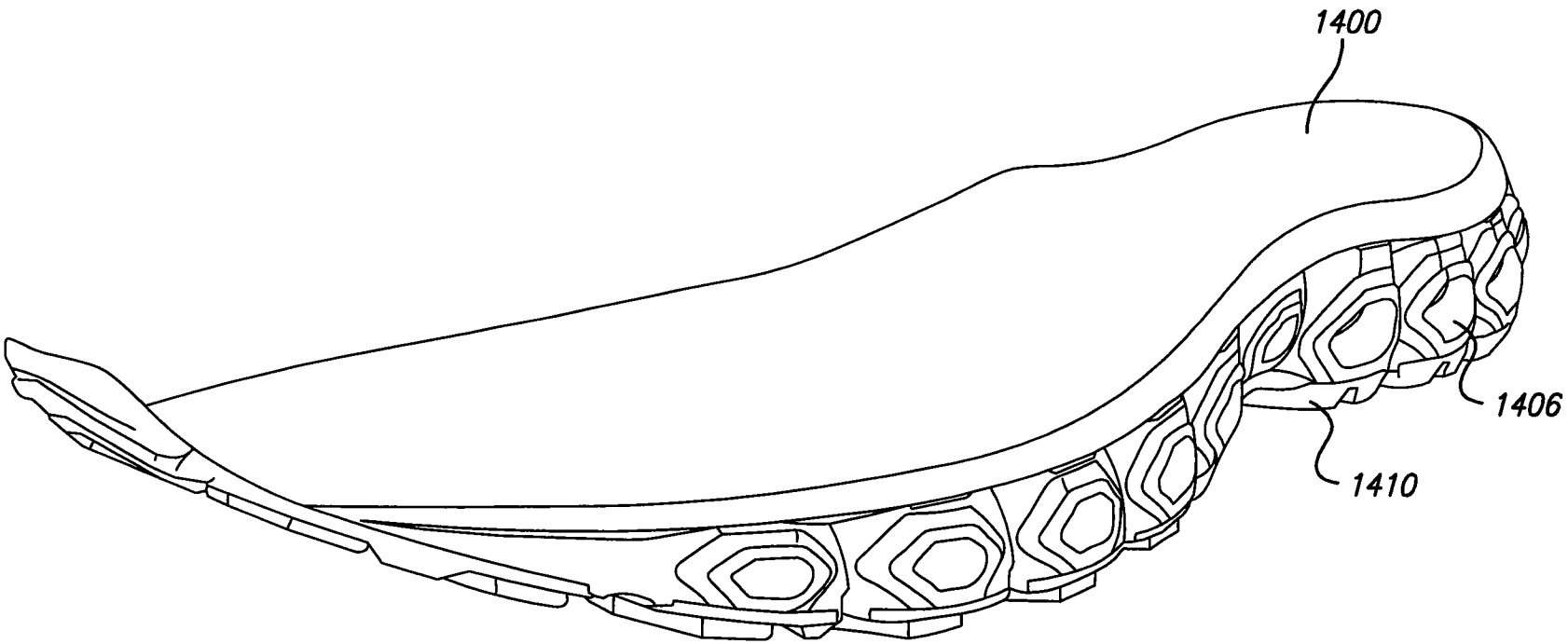
FIG. 16 is a lateral side view of the sole of FIG. 14.

FIGS. 14, 15 and 16 show a sole of an article of footwear according to one embodiment of the present invention. Sole of an article of footwear 1400 includes sole member 1402 (e.g., a midsole) having cavities 1404 therein. Disposed on sole member 1402 and over cavities 1404 are lateral flexible cage structure 1406 and medial flexible cage structure 1408. Outsole member 1410 fits over bottom portions of lateral flexible cage structure 1406 and medial flexible cage structure 1408.

Figure 17:
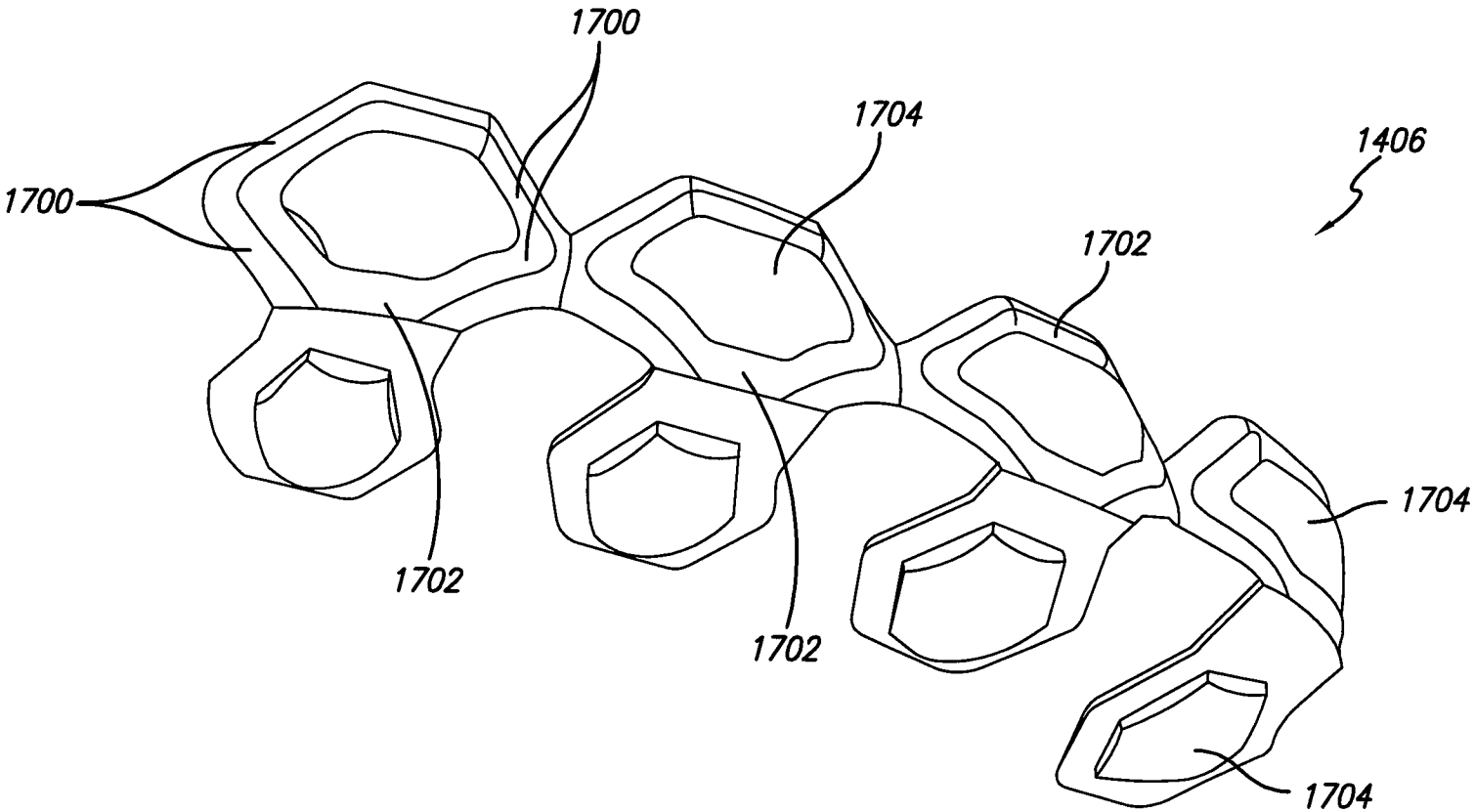
FIG. 17 is a view of a flexible cage structure shown in FIGS. 14, 15, and 16.

FIG. 17 shows lateral flexible cage structure 1406. Lateral flexible cage structure 1406 includes support arms 1700, linking members 1702, and windows 1704. In some embodiments, windows 1704 are also linking members. In other embodiments, windows 1704 are apertures. When disposed over sole member 1402 as shown in FIGS. 14-16, linking members 1702 and windows 1704 extend across cavities 1404. In some embodiments, windows 1704 include opaque, translucent, or transparent materials. In some embodiments, support arms 1700 and the linking members 1702 are plastic (e.g., TPU such as Elastollan®) and have a Shore A hardness of about 65 to about 95 such as about 65 to about 90; about 65 to about 85; or about 70. In some instances, windows 1702 are plastic (e.g., TPU such as Elastollan®) and have a Shore A hardness of about 65 to about 95 such as about 65 to about 90; about 65 to about 85; or about 85.

The breadth and scope of the present invention should not be limited by any of the above-described exemplary embodiments, but should be defined only in accordance with the following claims and their equivalents.

What is claimed is:

1. An article of footwear, comprising:

a midsole having a plurality of exterior sidewall surfaces and a plurality of cavities formed between adjacent exterior sidewall surfaces;

and a flexible cage member disposed on at least one of said exterior sidewall surfaces of said midsole and extending across at least one of said plurality of cavities, wherein said flexible cage member comprises:

a plurality of support arms disposed on said midsole; and a linking member extending across at least one of said plurality of cavities and connecting at least two of said plurality of support arms.

2. The article of footwear of claim 1, wherein at least one of said support arms bends outwardly from said midsole.

3. The article of footwear of claim 1, wherein all of said support arms bend outwardly from said midsole.

4. The article of footwear of claim 1, said midsole having a heel portion and said flexible cage member is disposed on a lateral side of said heel portion.

5. The article of footwear of claim 1, said midsole having a heel portion and said flexible cage member is disposed on a lateral side and a medial side of said heel portion.

6. The article of footwear of claim 5, wherein said flexible cage member comprises a first member disposed on said lateral side of said heel portion and a second member disposed on said medial side of said heel portion.

7. The article of footwear of claim 6, wherein said first member and said second member comprise a unitary structure.

8. The article of footwear of claim 1, wherein each of said plurality of support arms is disposed on said exterior sidewall surfaces.

9. The article of footwear of claim 8, wherein said exterior sidewall surfaces bend outwardly to receive said support arms.

10. The article of footwear of claim 1, wherein said support arms extend underneath a portion of a bottom surface of said midsole.

11. The article of footwear of claim 1, wherein a plurality of ground-engaging members are disposed on a portion of said flexible cage member.

12. The article of footwear of claim 1, wherein said plurality of support arms and said linking member form a unitary structure.

13. The article of footwear of claim 1, wherein said flexible cage member forms an aperture between said plurality of support arms and said linking member, and wherein at least a portion of said midsole is visible through said aperture.

14. The article of footwear of claim 1, said midsole having a plurality of interior sidewall surfaces, wherein said flexible cage member forms an aperture between said plurality of support arms and said linking member, and wherein at least a portion of at least one of said interior sidewall surfaces is visible through said aperture.

15. The article of footwear of claim 1, wherein said linking member substantially covers at least one of said cavities.

16. The article of footwear of claim 1, wherein said linking member only partially covers at least one of said cavities.

17. The article of footwear of claim 13, wherein said aperture is asymmetric.

18. An article of footwear, comprising:

a sole having a plurality of exterior sidewalls and a plurality of cavities formed therein, wherein each of said cavities is disposed between adjacent exterior sidewalls; and a flexible support member disposed on said sole, wherein at least one of said cavities is exposed when said flexible support member is disposed on said sole, said flexible support member comprising:

a plurality of support arms disposed on said exterior sidewalls; and a linking member connecting two or more of said plurality of support arms and extending across at least one of said cavities.

19. The article of footwear of claim 18, said sole having a heel portion and said flexible support member is disposed on a lateral side of said heel portion.

20. The article of footwear of claim 18, said sole having a heel portion and said flexible support member is disposed on a lateral side and a medial side of said sole heel portion.

21. The article of footwear of claim 20, wherein said flexible support member comprises a unitary structure.

22. The article of footwear of claim 18, wherein each of said support arms bends outwardly from said sole and said exterior sidewalls are bent outwardly to accommodate said support arms.

23. An article of footwear, comprising:

a midsole having a heel portion and a plurality of interior sidewall surfaces and a plurality of exterior sidewall surfaces and a plurality of cavities formed in said midsole, wherein each of said cavities is disposed between adjacent exterior sidewall surfaces;

a lateral flexible support member disposed on a lateral side of said heel portion; and a medial flexible support member disposed on a medial side of said heel portion, wherein said lateral and medial flexible support members comprise:

a plurality of support arms disposed on said exterior sidewall surfaces; and a linking member connecting two or more of said plurality of support arms and extending across at least one of said cavities, wherein each of said cavities is exposed when said lateral flexible support member and said medial flexible support member are disposed on said heel portion, and wherein each of said interior sidewall surfaces is exposed when said lateral flexible support member and said medial flexible support member are disposed on said heel portion.

* * * * *